US009244480B2

(12) United States Patent
Jurek

(10) Patent No.: US 9,244,480 B2
(45) Date of Patent: Jan. 26, 2016

(54) CONTROL DEVICE COMPRISING AT LEAST ONE PUSH-BUTTON

(71) Applicant: Gilles Jurek, Plaisance du Touch (FR)

(72) Inventor: Gilles Jurek, Plaisance du Touch (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 72 days.

(21) Appl. No.: 14/357,887

(22) PCT Filed: Nov. 9, 2012

(86) PCT No.: PCT/EP2012/004672

§ 371 (c)(1),
(2) Date: May 13, 2014

(87) PCT Pub. No.: WO2013/072031

PCT Pub. Date: May 23, 2013

(65) Prior Publication Data

US 2014/0305250 A1 Oct. 16, 2014

(30) Foreign Application Priority Data

Nov. 15, 2011 (FR) ..... 11 03467

(51) Int. Cl.
*H01H 13/705* (2006.01)
*H01H 13/14* (2006.01)
(Continued)

(52) U.S. Cl.
CPC ..... *G05G 1/02* (2013.01); *H01H 9/0235* (2013.01); *H01H 13/86* (2013.01);
(Continued)

(58) Field of Classification Search
CPC H01H 13/14; H01H 2221/064; H01H 13/125
USPC ..... 200/341, 344, 5 A; 400/490
See application file for complete search history.

(56) References Cited

U.S. PATENT DOCUMENTS 6,455,795 B1 * 9/2002 Murakami ..... H01H 13/14 200/345
7,189,932 B2 * 3/2007 Kim ..... H01H 25/041 200/17 R (Continued)

FOREIGN PATENT DOCUMENTS

DE 103 59 172 7/2005
DE 10 2005 001002 7/2006

(Continued)

OTHER PUBLICATIONS

International Search Report dated Dec. 21, 2012, in corresponding PCT application.

*Primary Examiner* — Renee S Luebke
*Assistant Examiner* — Ahmed Saeed
(74) *Attorney, Agent, or Firm* — Young & Thompson

(57) ABSTRACT

A control device includes at least one push-button (3) slideably mounted in a shell (1) in a push-button direction (P) substantially perpendicular to the shell (1), and elastic elements (50) that tend to cause the button (3) to emerge from the shell (1) and retaining elements (4, 30) that limit the travel of the button (3) against the action of the elastic elements (50). The retaining elements include at least one hook (30) of the button (3) of which a nose (300) projects perpendicularly to the push-button direction (P), and a rod (4) running parallel to the shell (1) to form an end stop for the button (3) in collaboration with the nose (300) of the hook (30), the rod (4) being mounted removably in the shell (1).

9 Claims, 4 Drawing Sheets

(51) Int. Cl.
*G05G 1/02* (2006.01)
*H01H 9/02* (2006.01)
*H01H 13/86* (2006.01)

(52) U.S. Cl.
CPC ..... *H01H 2209/01* (2013.01); *H01H 2223/04* (2013.01); *H01H 2231/026* (2013.01); *H01H 2231/032* (2013.01); *Y10T 74/20396* (2015.01)

(56) References Cited

U.S. PATENT DOCUMENTS 8,235,611 B2 * 8/2012 Chang ..... G06F 3/0202 200/341
8,546,714 B2 * 10/2013 Zhang ..... H01H 13/14 200/296
2011/0094868 A1 * 4/2011 Lamers ..... H01H 13/705 200/5 A
2011/0121942 A1 5/2011 Geldmacher

FOREIGN PATENT DOCUMENTS

DE 10 2009 022667 12/2010
EP 2 336 982 6/2011

* cited by examiner

CONTROL DEVICE COMPRISING AT LEAST ONE PUSH-BUTTON

The invention relates to a control device comprising at least one push-button, particularly for a motor vehicle remote control.

A remote control which, for example, controls the locking and unlocking of a motor vehicle, comprises one or more control push-buttons acting on a respective contactor mounted on an electronic circuit. The electronic circuit encodes the corresponding command and transmits it to the vehicle after the button has been pressed.

According to one example of the assembly of the button, a shell of the device comprises a housing for the button, which comprises two hooks passing through the shell via guiding holes. The hooks each have a nose which engages with the edge of the shell at the opening of the guiding hole. The contactor comprises elastic means which push the button back toward the outside of the shell. However, the noses engaged with the shell halt the travel of the button and prevent it from becoming disengaged from the housing.

The button is fitted onto the shell by snap fastening. The hooks in fact have a ramp which slides along the hole as the button is inserted into its housing. The ramps cause the hooks to flex so that the noses pass through the hole. When the noses reemerge on the other side of the hole, the hooks revert to their nonflexed position and the noses are engaged with the edge of the shell.

Such assembly requires that the hooks be of sufficient length so that the elastic limits of the material of which they are made is not reached. Such a construction therefore dictates a size of the device in terms of its thickness. Moreover, it is found that the durability of such an assembly is sometimes insufficient against the endurance requirements.

The invention seeks to provide a control device comprising at least one push-button which is slideably mounted and the thickness bulk of which can be reduced and the durability of which is improved.

With these objectives in sight, one subject of the invention is a control device comprising at least one push-button slideably mounted in a shell in a push-button direction substantially perpendicular to the shell, the device comprising elastic means that tend to cause the button to emerge from the shell and retaining means that limit the travel of the button against the action of the elastic means, characterized in that the retaining means comprise at least one hook of the button of which a nose projects perpendicular to the push-button direction, and a rod running parallel to the shell to form an end stop for the button in collaboration with the nose of the hook, the rod being mounted removably in the shell.

Because the rod is removable, it can be fitted after the shell and button have been assembled. Provision may also be made for the rod to be able to flex. It is therefore not necessary for the hook to flex and this means that the hook can be made very short. The thickness bulk of the device can thus be reduced. In addition, it is found that such an assembly performs well in durability testing. The rod is, for example, fitted by sliding it in its main direction in order to move it into position.

According to one embodiment, the rod is engaged with a plurality of aligned buttons. The same rod can be used for several buttons.

In particular, the rod comprises a curved end, the shell comprising a cleat against which the curved end comes to bear in order to limit the movement of the rod in its main direction. After the rod has slid into position, by pivoting it, the curved end is brought into engagement with the cleat. It is thus immobilized in its main direction and cannot come free.

According to one constructive arrangement, the button comprises two hooks, the device comprising two rods, each hook respectively collaborating with one of the rods. The buttons are thus better guided while being retained at two separate points.

According to an alternative form, the rods are made as a single piece by a U-shaped metal wire. The rods can thus be fitted in a single operation.

In particular, the hooks are symmetrical.

The shell may comprise a groove open in the push-button direction in the opposite sense to the action of the elastic means, and in which the rod is housed. Such a shape is easy to obtain by molding the shell. The noses of the hooks create an obstacle to the rod becoming disengaged via the open part of the groove. In particular, when the device comprises several buttons, these are not actuated simultaneously. Therefore, the rod is always kept pressed into the groove by at least one of the buttons via the hooks under the effect of the elastic means.

In a constructive arrangement, the shell comprises a guiding hole opening into the groove and accepting the hook of the button. The guiding hole in collaboration with the hook guides the sliding of the button. Likewise, it prevents the hook from disengaging from the rod when engaged with it.

Another subject of the invention is a method of assembling a device as described hereinabove, characterized in that the push-button is positioned on the shell acting against the action of the elastic means, the rod is placed on the shell, causing it to slide in its main direction so that the nose of the hook engages with the rod.

The invention will be better understood and other particulars and advantages will become apparent from reading the following description, the description making reference to the attached drawings among which:

Figure 1:
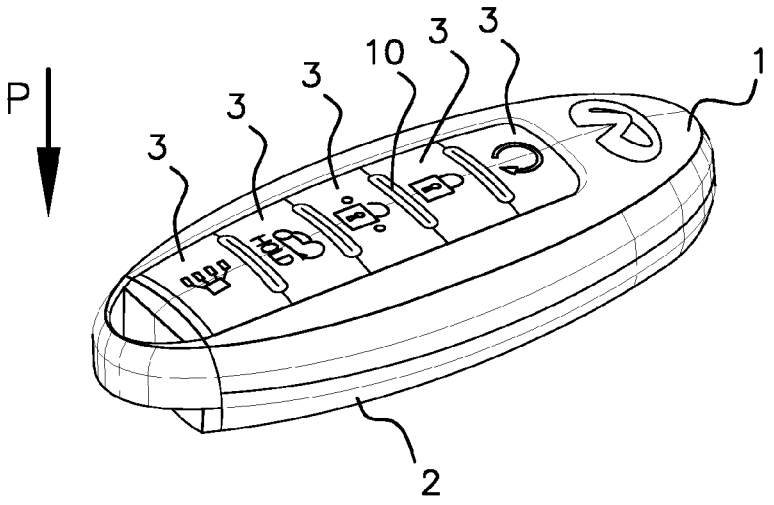
FIG. 1 is a perspective view of a control device according to one embodiment of the invention.

A control device according to the invention is shown in particular in FIG. 1. It comprises a series of five aligned push-buttons 3. It is formed of two shells 1, 2 assembled together by means that have not been depicted.

The buttons 3 are slideably mounted in one of the shells 1 in a push-button direction P substantially perpendicular to the visible surface of the shell 1. They are separated from one another by ribs 10 of the shell 1 running perpendicular to the alignment of buttons 3.

With reference to FIGS. 2 to 7, only the shell 1 bearing the buttons 3 has been depicted. At the location of each button 3, the shell 1 has a control hole 13 of substantially square shape (cf. FIGS. 5 and 7). The shell 1 comprises on each side of the row of control holes 13, two grooves 11 opening onto the inside of the shell 1. It also comprises two guiding holes 12, one on each side of each control hole 13 (cf. FIG. 7). The guiding hole 12 opens into the respective groove 11.

Figure 4:
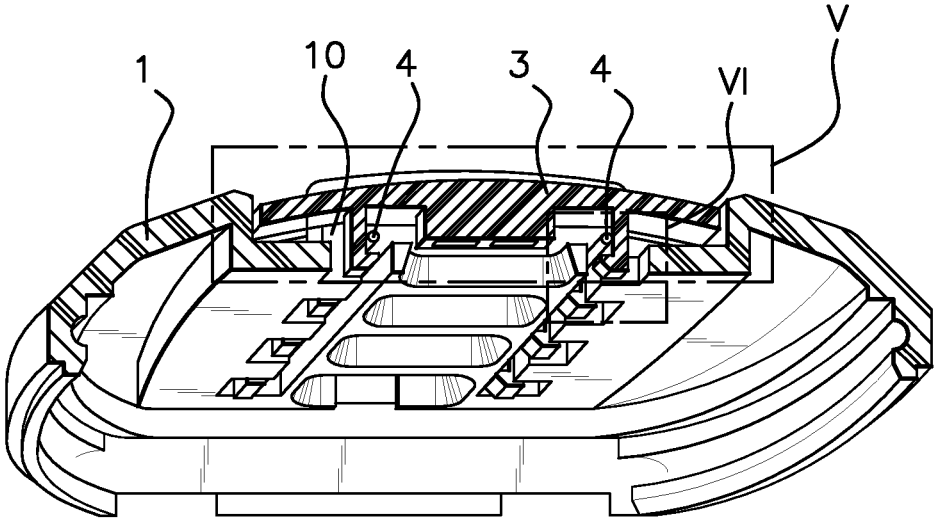
FIG. 4 is a view similar to FIG. 3, with the buttons in the depressed position.
Figure 5:
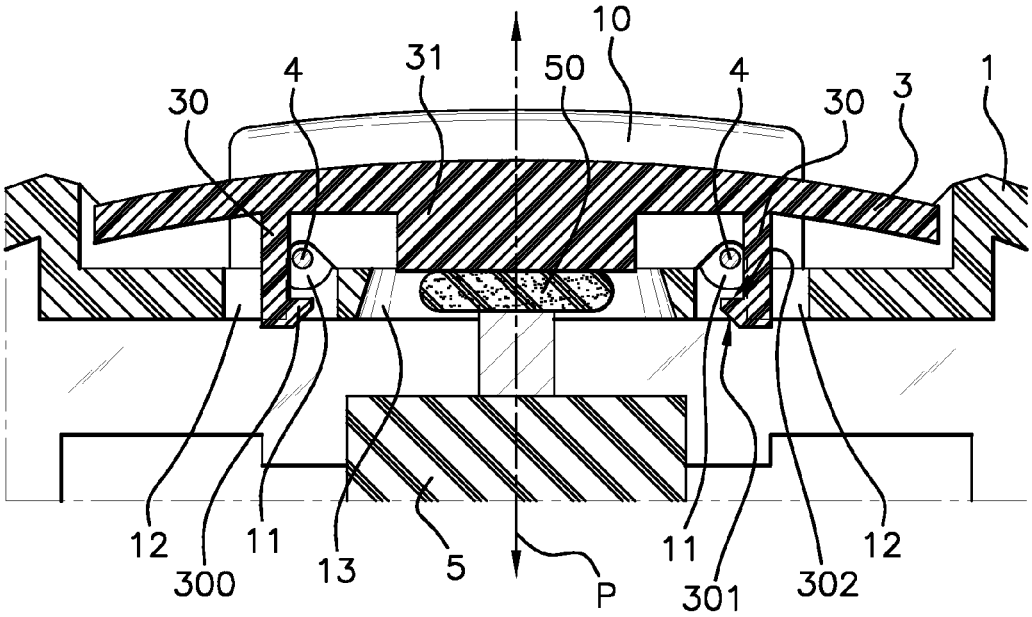
FIG. 5 is a view of detail V of FIG. 4.
Figure 6:
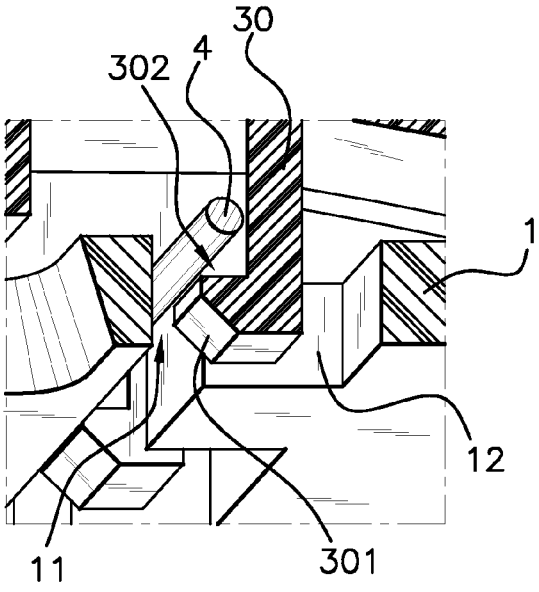
FIG. 6 is a view of detail VI of FIG. 4.
Figure 7:
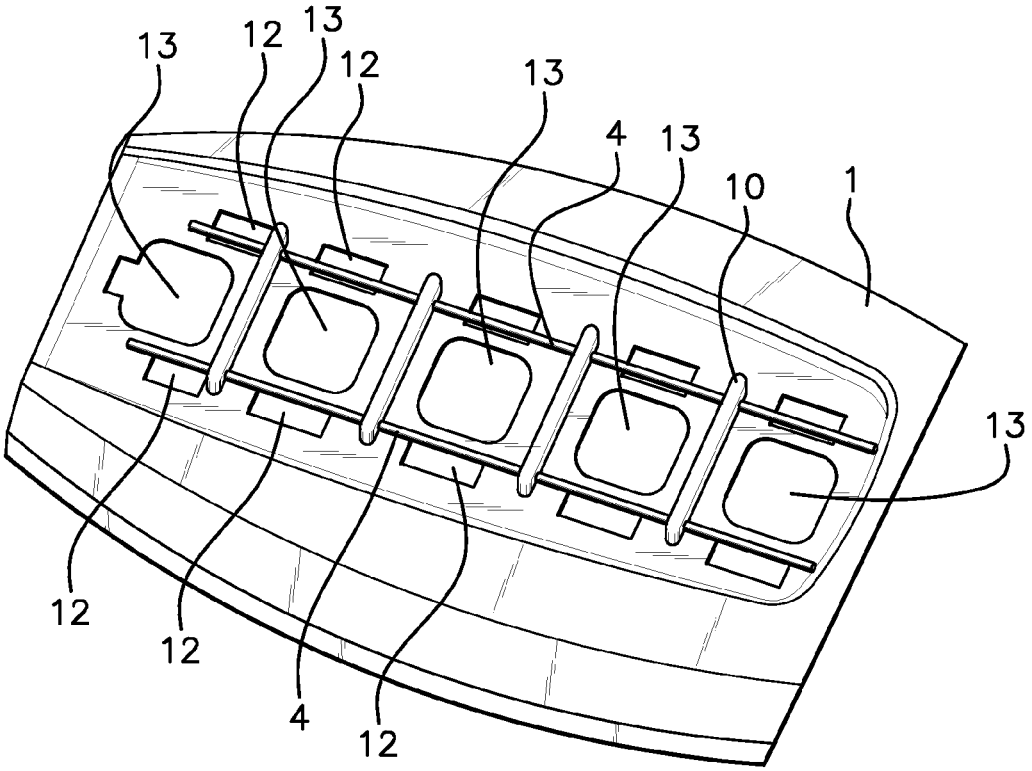
FIG. 7 is a perspective view of the shell and of the rods of the device of FIG. 1.

The control device comprises an electronic board 5 on which elastic means 50 are mounted opposite each of the buttons 3 (cf. FIG. 5). The elastic means 50 tend to cause the button 3 to protrude from the shell 1 by pressing against a central post 31 of the button 3 which extends through the control hole 13. The electronic board 5 comprises a contactor facing each button, the contactor being operated when the button is in a depressed position, as depicted in FIGS. 4 and 5.

Each button 3 comprises two hooks 30 extending substantially parallel to the post 31 and also toward the inside of the device and through the guiding holes 12. The hooks 30 are fitted between parallel planes of the guiding holes 12 which are perpendicular to the alignment direction. Each hook 30 also has a nose 300 projecting into the groove 11. The nose 300 has a catching face 302 substantially perpendicular to the push-button direction P, and a ramp 301 oriented toward the inside of the device obliquely with respect to the push-button direction P. The noses 300 face one another such that the hooks 30 are symmetrical with respect to one another.

The device further comprises two rods 4 which respectively extend along each of the grooves 11. The rods 4 are held in the bottom of the grooves 11 by the buttons 3, via the catching faces 302 which press the rods toward the bottom of the groove 11. This thrust is applied via the elastic means 50.

The rods 4 and the hooks 30 thus form retaining means limiting the travel of the button 3 against the action of the elastic means 50.

Figure 2:
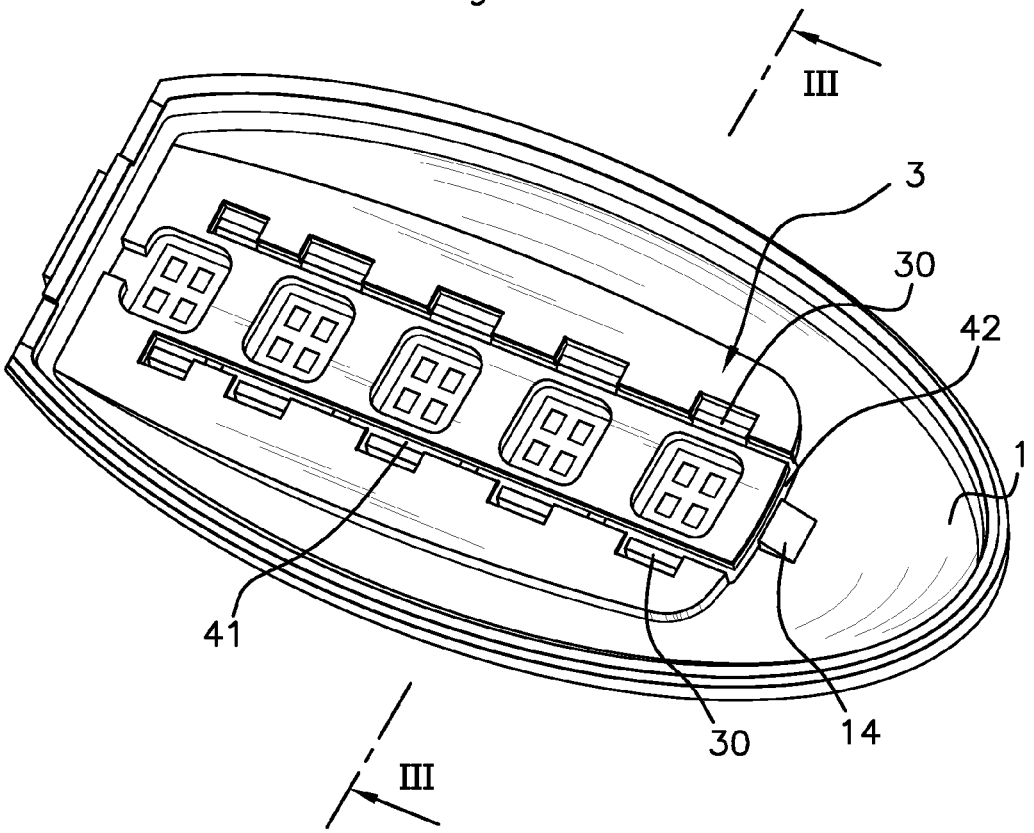
FIG. 2 is a perspective view from the inside of the device of FIG. 1, with certain components of the device not depicted.

Each rod 4 comprises a straight part 41 which extends along the groove 11 and a curved end 42 where it leaves this groove (cf. FIG. 2). The shell 1 comprises a cleat 14 against which the curved end 42 presses to limit the movement of the rod 4 in its main direction.

To assemble the control device, the starting point is to position the push-buttons 3 on the shell 1 by introducing them from the outside of the shell 1 into the control holes 13 and the guiding holes 12 until they are in abutment. Next, the rods are positioned on the shell 1 by sliding them along the grooves 11 in their main direction, then by pivoting the curved end 42 to place it against the cleat 14. The rod 4 thus remains removable. Then the electronic board 5 is positioned in such a way that the elastic means 50 are in contact with their respective buttons 3. The device is closed by assembling the two shells 1, 2 and the buttons 3 are released so that the nose 300 of each hook 30 engages with its rod 4 under the action of the elastic means 50. In this way, the rods 4 form end stops for the buttons 3 by collaborating with the noses 300 of the hooks 30.

Figure 3:
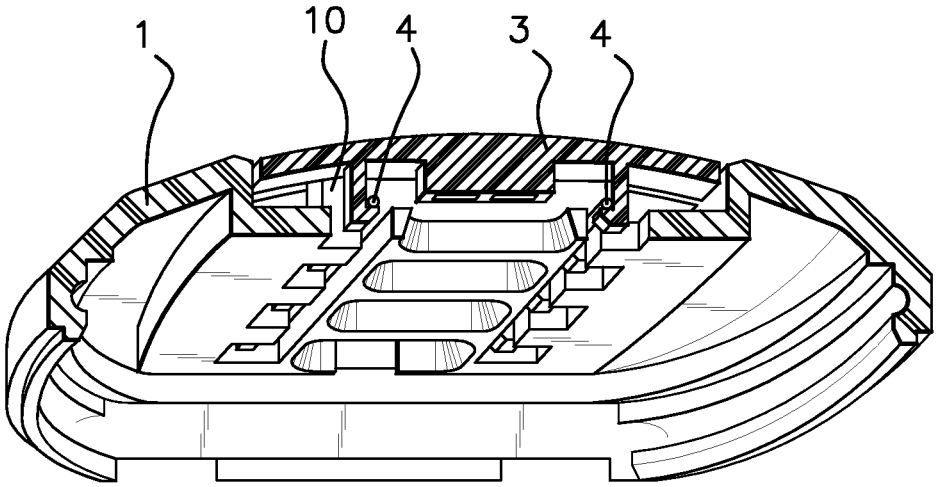
FIG. 3 is a perspective view of the subassembly of FIG. 2, in section on the plane III-III.

During use, the elastic means 50 keep the buttons 3 in a released position, as shown in FIGS. 1 and 3. The user actuates one of the buttons 3 in order to bring it, against the action of the elastic means 50, into the depressed position as depicted in FIGS. 4 and 5, in order to actuate the contactor. The hooks 30 slide in the guiding holes 12 and along the rods 4. The rods remain held in the grooves 13 by the other buttons 3. On releasing the button 3, the contactor is deactivated and the hooks 30 come back into abutment against the rods 4 via their catching faces 302.

In an alternative form, the rods 4 are produced as a single piece as a U-shaped metal wire.

According to yet another alternative form, the groove 11 may be widened in places. The rod 4 can thus flex in the groove 11 as the button 3 is introduced into the guiding holes 12, by being pushed by the ramp 302 of the noses 300.

One improvement is to provide a boss on the hook 30 on the face that slides along the rod. In this way, the effort required to depress the button 3 is altered, creating a hard point where the hook moves away from the rod, followed by an easier travel.

The invention claimed is:

1. A control device comprising at least one push-button (3) slideably mounted in a shell (1) in a push-button direction (P) substantially perpendicular to the shell (1), the device comprising elastic means (50) that tend to cause the button (3) to emerge from the shell (1) and retaining means (4, 30) that limit the travel of the button (3) against the action of the elastic means (50), characterized in that the retaining means comprise at least one hook (30) of the button (3) of which a nose (300) projects perpendicular to the push-button direction (P), and a rod (4) running parallel to the shell (1) to form an end stop for the button (3) in collaboration with the nose (300) of the hook (30), the rod (4) being mounted removably in the shell (1).

2. The device as claimed in claim 1, in which the rod (4) is engaged with a plurality of aligned buttons (3).

3. The device as claimed in claim 2, in which the rod (4) comprises a curved end (42), the shell (1) comprising a cleat (14) against which the curved end (42) comes to bear in order to limit the movement of the rod (4) in its main direction.

4. The device as claimed in claim 1, in which the button (3) comprises two hooks (30), the device comprising two rods (4), each hook (30) respectively collaborating with one of the rods (4).

5. The device as claimed in claim 4, in which the rods (4) are made as a single piece by a U-shaped metal wire.

6. The device as claimed in claim 3, in which the hooks (30) are symmetrical.

7. The device as claimed in claim 1, in which the shell (1) comprises a groove (11) open in the push-button direction (P) in the opposite sense to the action of the elastic means (50), and in which the rod (4) is housed.

8. The device as claimed in claim 7, in which the shell (1) comprises a guiding hole (12) opening into the groove (11) and accepting the hook (30) of the button (3).

9. A method of assembling a device as claimed in claim 1, characterized in that the push-button (3) is positioned on the shell (1) acting against the action of the elastic means (50), the rod (4) is placed on the shell (1), causing it to slide in its main direction so that the nose (300) of the hook (30) engages with the rod (4).

* * * * *